US005295594A

United States Patent [19]

Melzian et al.

[11] Patent Number: 5,295,594

[45] Date of Patent: Mar. 22, 1994

[54] WALL PANEL MOUNTING APPARATUS

[75] Inventors: John Melzian, Rancho Palos Verdes; Mel Evenson, San Pedro, both of Calif.

[73] Assignee: Rubbermaid Office Products Group, Inc., Inglewood, Calif.

[21] Appl. No.: 900,856

[22] Filed: Jun. 18, 1992

[51] Int. Cl.[5] ..... A47F 5/08

[52] U.S. Cl. ..... 211/87; 211/103; 248/215

[58] Field of Search ..... 211/87, 105.1, 103; 248/214, 215

[56] References Cited

U.S. PATENT DOCUMENTS

| | | | |
|---|---|---|---|
| 782,738 | 2/1905 | Faust | 248/215 |
| 1,749,576 | 3/1930 | Evans | 211/87 |
| 2,573,348 | 10/1951 | Meadows | 211/103 |
| 3,002,666 | 10/1961 | Silverman | 211/87 |
| 3,286,850 | 11/1966 | Ruhnke | 211/105.1 |
| 3,516,634 | 6/1970 | Salava et al. | 211/87 |
| 4,059,248 | 11/1977 | Kuntz | 248/214 |
| 4,550,893 | 11/1985 | Wiersema et al. | 211/103 |

*Primary Examiner*—Paula A. Bradley
*Assistant Examiner*—Chuck Y. Mah
*Attorney, Agent, or Firm*—Price, Gess & Ubell

[57] ABSTRACT

An apparatus is provided for mounting a coat rack, bookshelf or the like to a wall panel. The apparatus includes a pair of side supports which support opposing ends of the coat racks, bookshelves or the like. The apparatus is provided with a mounting mechanism which allows the apparatus to mount to either a top edge of the wall panel or to a set of slotted standards on a front surface of the wall panel. One of two specific mounting mechanisms are provided. The first, an L-shaped bracket, allows the apparatus to be mounted over the top edge of the wall panel. The second, a V-shaped hook plate, allows the apparatus to be mounted into slotted standards. Thus, a single pair of side supports accommodates either mounting arrangement. A leveling mechanism is also provided for leveling the apparatus.

14 Claims, 7 Drawing Sheets

FIG. 6
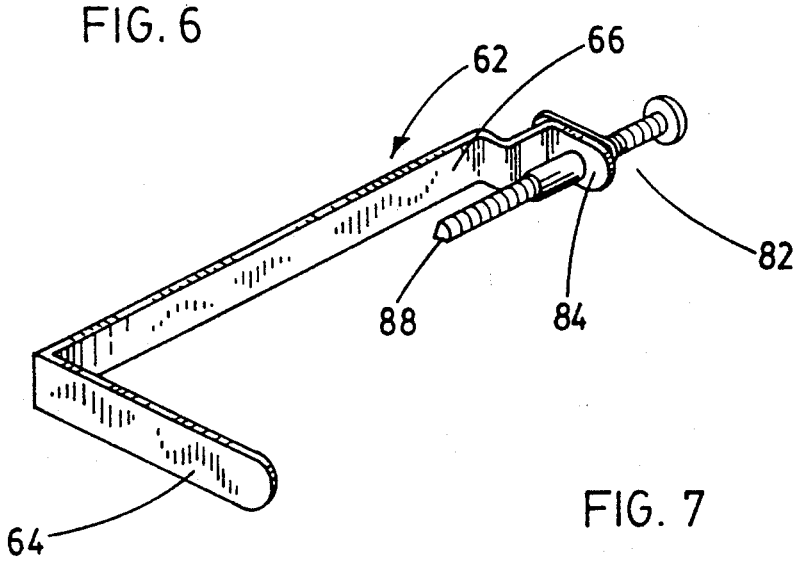
FIG. 7
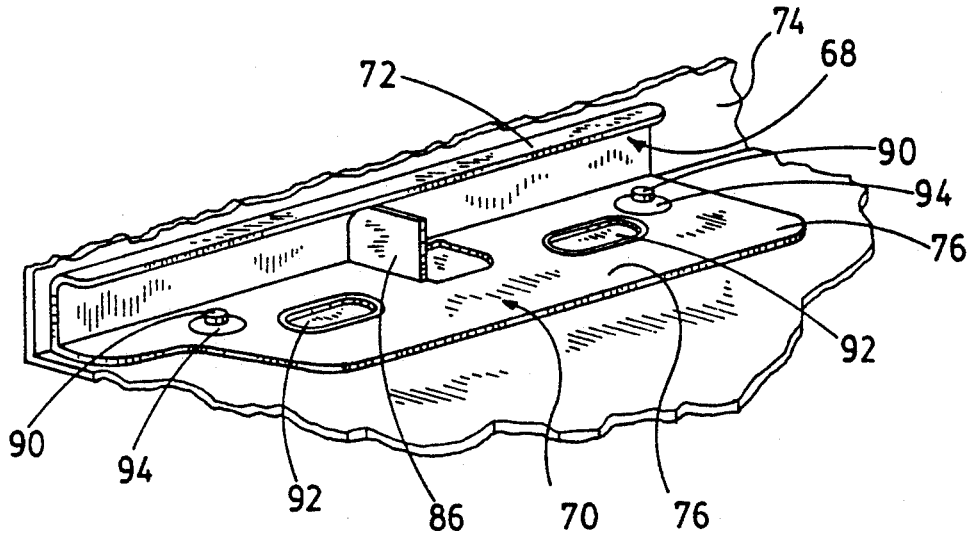
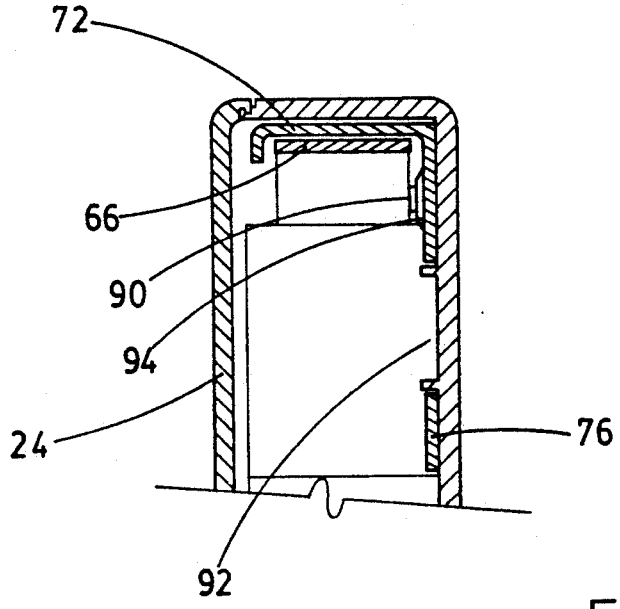
FIG. 8

WALL PANEL MOUNTING APPARATUS

BACKGROUND OF THE INVENTION

1. Field of the Invention

The invention generally relates to accessories for mounting to wall panels and, in particular, to a coat rack accessory for mounting to a wall panel.

2. Description of Related Art

Wall panel systems are widely used. Such systems typically include a plurality of wall partition panels connected by means of vertical standards, with the wall panels configured to provide individual offices for employees. The individual offices may be rather small, and it is desirable to provide an efficient means for mounting an office accessory such as a coat rack or bookshelf directly to the wall panel system, thus freeing space on the office desk or floor which would otherwise be occupied by the office accessory.

An example of an apparatus for mounting a coat hanger, or the like, to a wall panel system is provided in U.S. Pat. No. 5,110,079. A coat hanger is hung from an extending portion of the apparatus. Although useful, the apparatus of U.S. Pat. No. 5,110,079 does not provide a mounting apparatus for mounting an entire coat rack or a bookshelf to a wall unit. Furthermore, the apparatus of U.S. Pat. No. 5,110,079 must be mounted into the slots of a slotted wall standard and cannot be mounted to other portions of a wall panel. The apparatus of U.S. Pat. No. 5,110,079 does not allow for mounting of a bookcase or any other office accessory having a pair of opposing ends which must be mounted horizontally along a front portion of a wall panel.

Thus, although providing a useful apparatus for hanging a single coat hanger from a wall panel, U.S. Pat. No. 5,110,079 does not provide an ideal mounting apparatus capable of mounting an entire coat rack or a bookshelf onto a wall panel.

SUMMARY OF THE INVENTION

From the foregoing, it can be appreciated that there is a need to provide an improved apparatus for mounting coat racks and the like to a wall panel system. It is a further object to provide such a mounting apparatus with the ability to mount either into the slots of a slotted wall standard or along a top edge of a wall panel, at a location remote from a slotted standard. It is a further object to provide such a mounting mechanism with the ability to securely hold a number of horizontal coat racks or one or more bookshelves. It is further desirable that the mounting apparatus be lightweight, durable, relatively inexpensive, and easy to mount to a wall panel to allow for convenient use in a busy office environment.

These and other objects of the invention are achieved by the provision of a wall panel mounting apparatus for mounting accessories to a wall panel having left and right vertical side support panels, with each side panel having an accessory-mounting means for receiving and holding one end of a pair of opposing ends of an accessory such as a coat rack, bookshelf, or the like. Each side panel is provided with a wall panel mounting means for mounting a rear vertical edge of the side panel to a front vertical surface of the wall panel.

In a first embodiment, the means for securing a side support panel to the wall panel comprises an L-shaped mounting bracket for mounting over a top edge of a wall panel. The L-shaped bracket includes a base portion held along a lower inside surface of the top wall of the support panel and includes a free end mountable over a top edge of the wall panel. Means are provided for sliding the base portion of the mounting bracket with respect to the top wall of the support panel to tighten the free end of the bracket over the top of the wall panel. Thus, the side support panels of the apparatus are mountable along a top edge of a wall panel and need not be mounted into a slotted standard. When mounted, a rear vertical edge of each support panel rests firmly against a front surface of the wall panel, and the pair of support panels are positioned in spaced relation with one or more coat racks, bookshelves, or the like, extending between the side support panels.

Typical wall panel systems have a soft or cushioned front surface which may deform in the vicinity of the rear edges of the side panels while coats are hung from the coat rack, causing the side support panels to tilt inwardly at an angle. Accordingly, a means is provided within each side panel for leveling the side support panels. Preferably, the leveling means comprises an eccentrically-mounted circular disk positioned in proximity to an open rear edge of the side support panel. As a result of the eccentric mounting of the disk, a portion of the disk extends beyond the rear edge of the support panel by a selectable amount to abut the front cushioned surface of the wall panel. By selecting the amount by which the eccentric circular disk extends beyond the rear edge, the entire side support panel is tilted outwardly from the cushioned front surface of the wall panel by an amount sufficient to compensate for any deformation in the cushioned surface of the wall panel. In this manner, the side support panels are leveled with front and rear vertical walls of the support panel are oriented vertically.

In accordance with a second preferred embodiment of the invention, the means for securing each side support panel to the wall panel includes a plate for engaging with slots formed in a slotted standard of the wall panel such that the apparatus need not be mounted along a top edge of a wall panel, but can be mounted at any height along a slotted vertical standard. In the second embodiment, the means for mounting the apparatus the wall panel comprises an integrally-formed hook plate having one or more depending tabs, each sized for insertion into a slot of the slotted standard. The hook plate forms an upwardly-pointing V-hook. The side support panel includes an aperture or slot formed near the rear edge thereof which is sized and shaped for closely receiving the hook plate, such that the support panel is mountable to the hook plate while the hook plate is mounted to the slotted standard.

Preferably, the side support panels of the above-described embodiments are identical. In this manner, a single side support panel may be provided both with a bracket-mounting means for mounting to a top edge of a wall panel and a slot-mounting means for mounting into the slots of a wall standard. One can therefore choose whether the apparatus is to be mounted along a top edge of the wall panel or at any vertical position along vertical slotted standards. After selecting a suitable location, the appropriate mounting bracket is inserted into the wall panel. Specifically, for mounting over a top edge of the wall panel, the L-shaped bracket is inserted into a track formed along a lower surface of a top wall of the side support panel. For mounting into a slotted standard, the V-shaped mounting plate is inserted into the aperture formed in the rear portion of the support panel.

In both embodiments, the side support panels are configured to distribute weight and stress along side walls of the support panel rather than along the top wall of the panel. This allows a considerable weight in the form of books or coats or the like to be placed on the apparatus or hung from the apparatus without damaging the mounting brackets or the side panels.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 6 provides a perspective view of an L-shaped mounting bracket of the embodiment of FIG. 1;

FIG. 7 provides a perspective view of a portion of the support panel of FIG. 1, particularly showing a track for receiving the L-shaped bracket of FIG. 6;

FIG. 8 is a cross-sectional view of the support panel of FIG. 2 taken along line 8—8;

DESCRIPTION OF THE PREFERRED EMBODIMENTS

Figure 1:
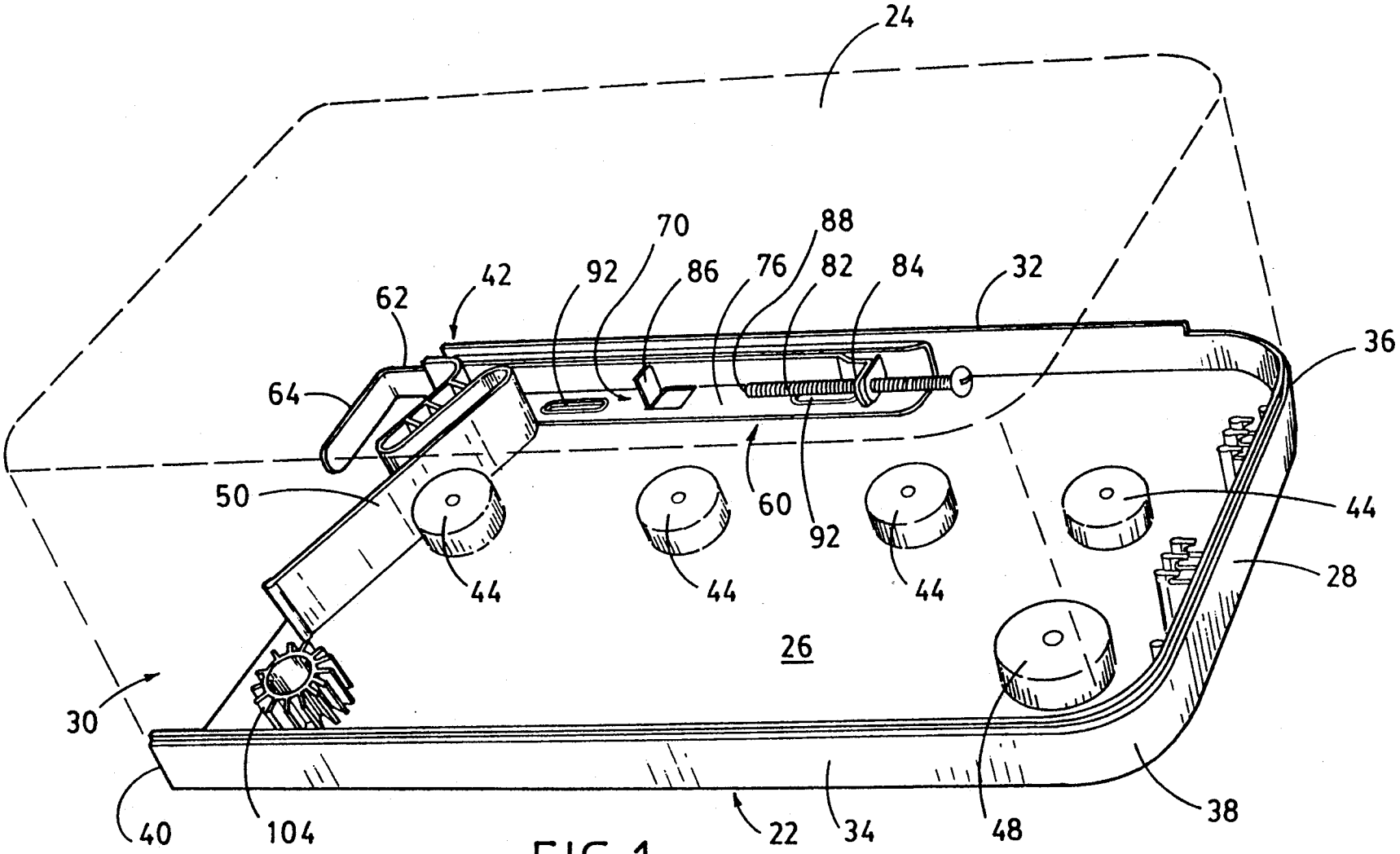
FIG. 1 provides a perspective view of a side support panel constructed in accordance with the invention, configured for mounting over a top edge of a wall panel system, with a detachable panel shown in phantom lines.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an apparatus for mounting coat racks, bookshelves or the like to a wall panel system.

Referring to FIGS. 1–8, a preferred embodiment of a wall panel mounting apparatus 10 will now be described. Mounting apparatus 10, shown in its entirety in FIG. 3, includes left- and right-side support panels 12 and 14 holding a set of coat racks 16. Rear edges of side panels 12 and 14 are mounted along a front surface 18 of a wall panel 20.

FIG. 1 provides a perspective view of the interior of left-side support 12. Side support 12 includes a housing formed from a main panel 22 and a detachable side wall 24, shown in phantom lines. Main panel 22 is generally rectangular and includes a side wall 26, a front wall 28, a top wall 32, and a bottom wall 34. A rear portion or edge 30 is open. Front upper and lower corners of main panel 22 are curved, as shown by reference numerals 36 and 38, respectively. Rear upper and lower corners of main panel 22 form sharp right angles, as shown by reference numerals 42 and 40, respectively.

Figure 2:
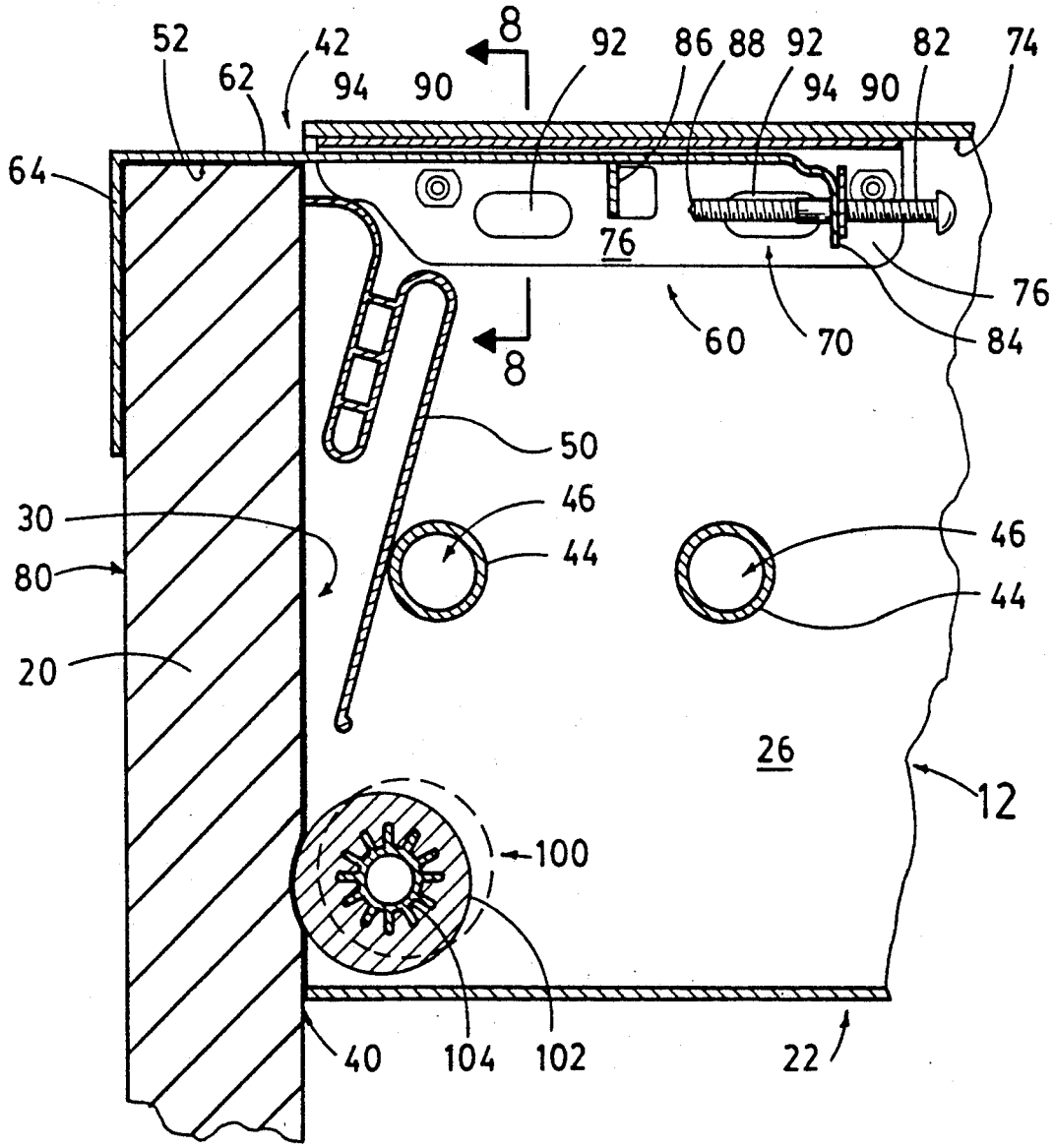
FIG. 2 is a cross-sectional view of the side support panel of FIG. 1, shown mounted to a wall panel.
Figure 3:
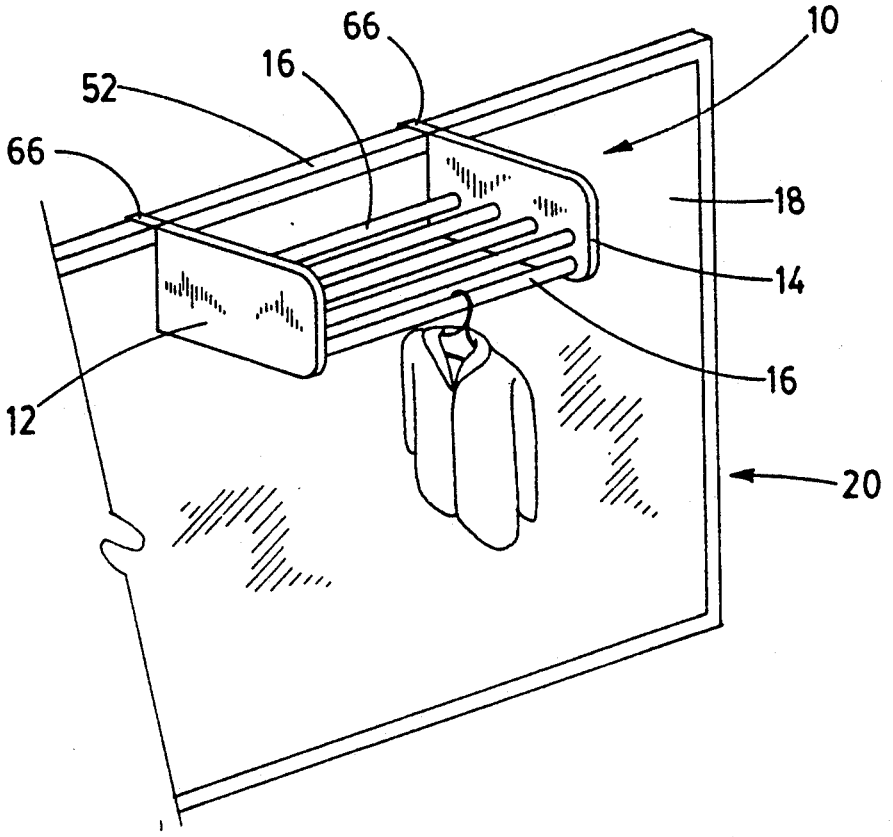
FIG. 3 is a perspective view of a complete wall panel mounting apparatus, shown mounted along a top edge of a wall panel, and shown supporting a coat along a coat rack.

Side wall 24 is detachably mounted to main panel 22, and together side wall 24 and panel 22 form a single hollow rectangular housing. Main panel 22 includes a set of raised cylindrical coat rack mounting members 44. Each raised cylindrical mounting member 44 defines a cylindrical shaft 46 which is open along an outer surface of side wall 26 (FIG. 2). Hollow shafts 46 are sized for receiving one end of a cylindrical coat rack 16 (FIG. 3). Main panel 22 illustrated in the figures includes a horizontal linear row of four equally-sized members 44 for holding four equally-sized coat racks in a horizontal plane at a constant height. A fifth raised mounting member, identified by reference numeral 48, has a larger diameter to allow the mounting of one possibly larger-diameter coat rack.

Main panel 22 also includes a serpentine perpendicular interior wall 50 which defines a slot for receiving a V-shaped mounting plate, to be described below with reference to FIGS. 9–13.

Both left- and right-side support panels 12 and 14, together shown in FIG. 3, are substantially identical, but are mirror images of each other. Thus, where left-side support panel 12 includes open cylindrical shafts formed along a right outer surface, right-side support panel 14 includes open cylindrical shafts formed along a left outer side surface. This allows the left and right panels 12 and 14 to be positioned in spaced relation for receiving opposing ends of coat racks 16.

An L-shaped mounting bracket assembly 60 is provided within each side panel for mounting the side support panel to wall panel 18 along a top edge 52 thereof. Mounting assembly 60 includes an L-shaped bracket 62, shown most clearly in FIG. 6, which includes a free end 64 provided for mounting over top edge 52 of wall panel 20. A base end 66 of bracket 62 is received within a track 68 formed within a track assembly 70. Track assembly 70 is shown most clearly in FIG. 7. Track assembly 70 is mounted to interior side surfaces of main panel 22. Specifically, a top portion 72 of assembly 70 is mounted against an interior surface 74 of top wall 32. A side portion 76 of assembly 70 is mounted against inner side surface of side wall 26. In this manner, L-shaped bracket 62 is slidably received within track 68 with L-shaped free end 64 depending downward over a rear side wall surface 80 of wall panel 20. A tightening mechanism is provided for tightening L-shaped bracket 62 over top edge 52 of wall panel 20. The tightening mechanism includes a threaded bolt 82 mounted through a bore formed in a depending tab 84 of base end 66 of the L-shaped mounting bracket. An abutment plate 86 extends from, or is mounted onto, side portion 76 of track assembly 70. In use, as shown most clearly in FIG. 2, bolt 82 is threaded through depending tab 84 such that a free end 88 of the bolt abuts plate 86. In this configuration, by rotating bolt 82 while maintaining free end 88 against abutment plate 86, the position of L-shaped bracket 66 within track 68 is selectively varied. In particular, L-shaped bracket 66 may be mounted over top edge 52 of wall panel 20 and then tightened onto wall panel 20 by appropriate manual rotation of threaded bolt 82.

To secure track assembly 70 to the inner surface of side wall 26, a set of circular and elongated lands 90 and 92, respectively, are provided alongside surface 78. Appropriately-sized apertures are formed within vertical portion 76 of track assembly 70 for closely receiving lands 90 and 92. Washers 94 (FIG. 7) may be inserted around circular lands 90 to secure track assembly 70 to side panel 26.

With this configuration, weight and stress caused by the mounting of coats or the like between the side support panels is borne primarily along the vertical side walls of each side support panel. Thus, although the L-shaped bracket is mounted within a track positioned along top wall 32, the top wall does not bear the brunt of the tension and stress. Rather, tension and stress is statically transferred from track assembly 70 to side wall 26. Coats or books mounted between support panels 12 and 14 cause a downward force along support panels 12 and 14 which tends to pivot forward walls 28 downwardly with respect to upper inside corner 42. However, open rear surface 30 remains in abutment with wall panel 20, such that the pivoting force is resiliently supported by wall panel 20. Hence, a considerable amount of weight may be hung from coat rack 16 or mounted on a bookshelf between the side support panels, without causing any damaging or buckling of the components of each support panel.

Typically, front surface 18 of wall panel 20 is cushioned. As a consequence, lower rear edge 40 of each side support panel tends to pivot inwardly into the wall panel, causing a deformation of the foam of the wall panel. If uncompensated, side support panels 12 and 14 will not hang level. That is, top wall 32, which is preferably oriented horizontally, instead tilts forwardly.

To level the side support panels to prevent a forward tilt, a leveling mechanism 100 is provided in the vicinity of the lower inside corner 40 of each side support panel. Leveling mechanism 100, shown fully in FIG. 2, includes a circular disk 102, which is eccentrically mounted to a toothed mounting peg 104. Disk 102 is provided with a bore which, rather than being formed at the center of disk 102, is instead formed at an intermediate point between a center and a periphery of disk 102. The bore within disk 102 is provided with complementary teeth to securely engage toothed peg 104 to prevent disk 102 from rotating about peg 104. Mounting peg 104 is positioned sufficiently close to open rear edge 30 such that a portion of disk 102 extends outwardly through open rear edge 30 to directly abut wall panel 20. The extent to which disk 102 extends beyond rear edge 30 is determined by the angular position of disk 102 on mounting peg 104. Thus, the eccentric mounting configuration of disk 102 to peg 104 allows disk 102 to be mounted at an angle such that it extends a desired amount through rear edge 30. To vary the amount by which disk 102 extends through rear edge 30, disk 102 is manually removed from peg 104 and rotated by a desired amount, then remounted to peg 104. Thus, by rotating disk 102 to the orientation shown in phantom lines in FIG. 2, disk 102 extends a lesser amount from rear edge 30.

By extending through open rear edge 30 and abutting wall panel 20, disk 102 acts to level support panel 12. In this manner, disk 102 compensates for any deformation within the front foam surface of Wall panel 20. If the wall panel is particularly soft, then disk 102 is manually rotated such that it extends significantly beyond open rear edge 30. If wall panel 20 is fairly firm, then disk 102 is manually rotated such that it does not extend considerably beyond open rear edge 30. If the forward surface of wall panel 20 is firm, disk 102 may be removed entirely or may be oriented such that it does not extend at all through open rear edge 30.

Thus, leveling mechanism 100 provides a simple and inexpensive mechanism for leveling the support panels. Other leveling mechanisms may alternatively be employed which may, for example, include other forms of an abutment member extending outwardly from open rear edge 30.

Figure 5:
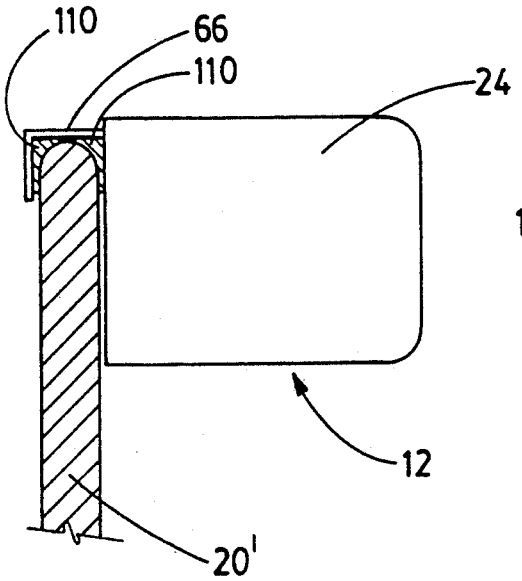
FIG. 5 is a side view of an entire side support panel shown mounted to a wall panel, with the wall panel shown in cross-section.
Figure 4:
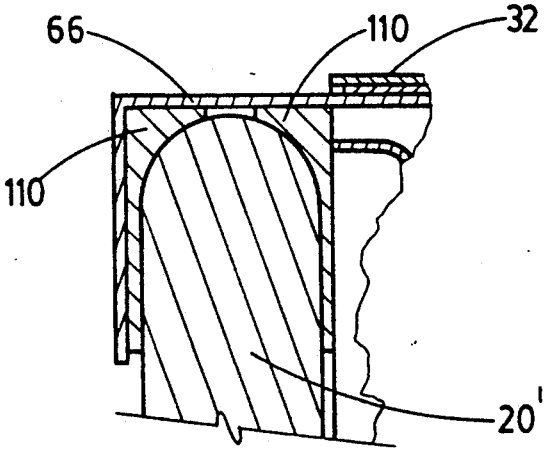
FIG. 4 provides a side cross-sectional view of the side support panel of FIG. 1, shown with a set of spacing blocks provided to allow the apparatus to be mounted over a wall panel having a curved top edge.

Referring now to FIGS. 4 and 5, mounting blocks are provided for allowing apparatus 10 to securely mount to a wall panel having a curved top edge. To this end, a pair of positioning blocks 110 are provided which have curved inner lower surfaces provided to match a curved upper edge of a wall panel 20'. Each positioning block 110 also includes an upper outward surface having a rectangular cross-section. By mounting positioning blocks 110 over the curved upper edge of wall panel 20', a substantially rectilinear mounting surface is provided over which L-shaped bracket 66 is securely mounted. If desired, a single integrated positioning block may be provided rather than a pair of separate blocks. However, a pair of separate blocks 110 is preferred since separable blocks more conveniently accommodate a wall panel of arbitrary width. Positioning blocks of appropriate shapes may be provided to accommodate wall panels having a top edge of a differing shape.

What has been described thus far is an apparatus 10 provided with a means for mounting the apparatus to a top edge of a wall panel. Referring to the remaining figures, an alternative mounting mechanism will now be described which allows mounting apparatus 10 to be mounted into a slotted vertical standard at any one of a variety of possible heights. The embodiment of FIGS. 9–13 is identical to that of FIGS. 1–8, except that the L-shaped mounting bracket of the first embodiment which mounts over the top of a wall panel is replaced with a V-shaped mounting plate 120 which mounts into the slots of a vertical standard. Further, because the support panel of the second embodiment rests against a metal standard rather than a cushioned portion of a wall panel, the eccentric disk-leveling mechanism is not required.

Figure 9:
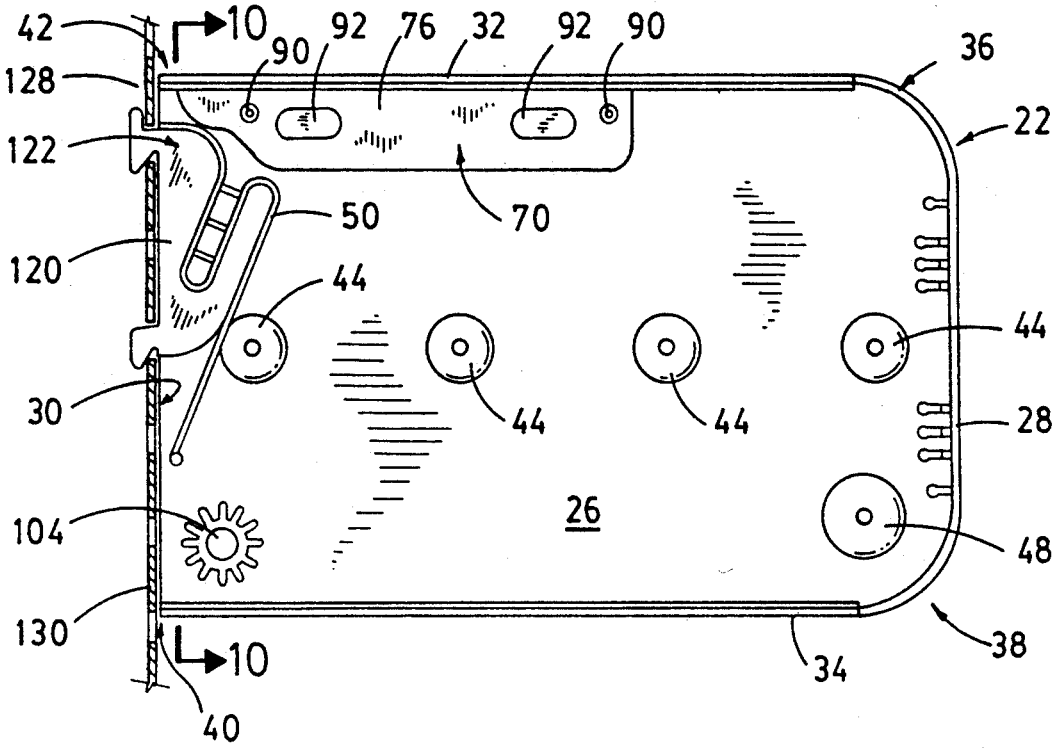
FIG. 9 provides a side view of the side support panel of FIG. 1 (shown without the detachable panel), configured for mounting to the slots of a slotted wall standard by means of a V-shaped hook plate.
Figure 10:
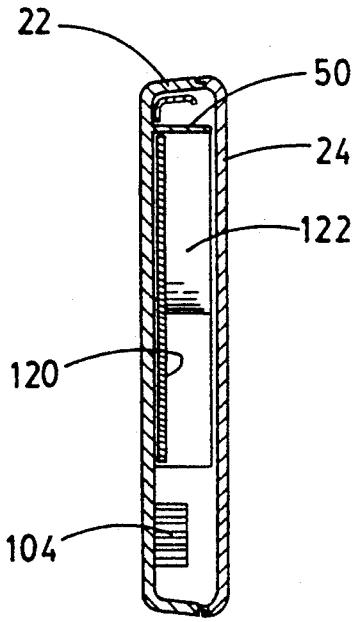
FIG. 10 provides a side cross-sectional view of the embodiment of FIG. 9 taken along line 10—10, shown with the detachable panel.
Figure 11:
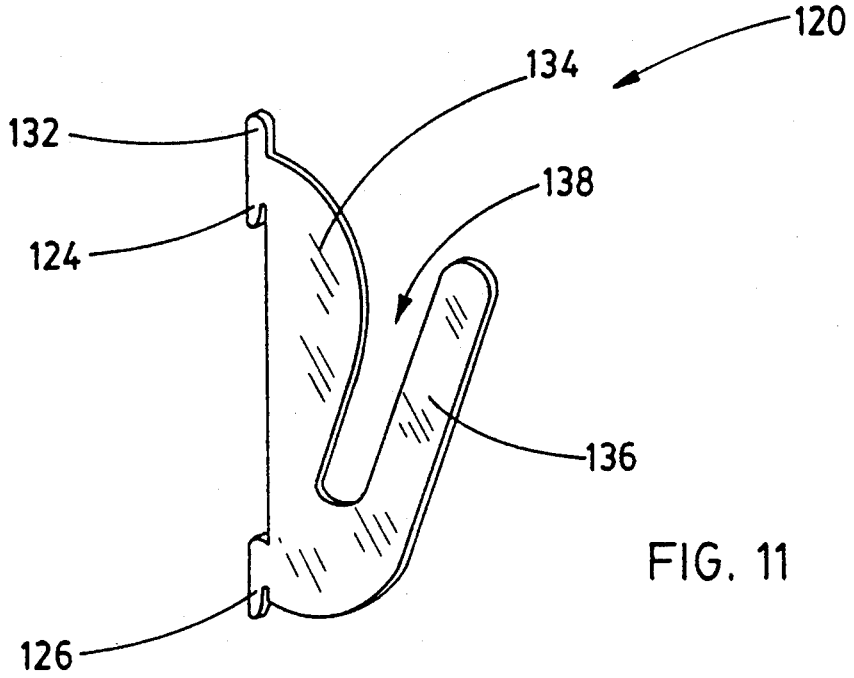
FIG. 11 provides a perspective view of the V-shaped mounting plate of FIG. 9.

FIG. 9 provides a cross-sectional view of side support panel 12 without detachable panel 24. A V-shaped mounting plate 120 is mounted Within an aperture 122 formed by interior wall 50. Bracket 120 is shown most clearly in FIG. 11. As can be seen, mounting bracket 120 includes a pair of mounting tabs along a rear edge thereof, respectively denoted by reference numerals 124 and 126. Depending tabs 124 and 126 are sized for insertion into an interior hollow portion of slotted vertical standard 130, shown in FIG. 9. Upper tab 124 includes an upwardly-extending portion 132 which, as can be seen in FIG. 9, is also received within interior 128 of slotted standard 130. Upper-extending portion 132 is provided to help secure bracket 120 within slots of slotted standard 130.

The remaining portions of plate 120 include a base 134 and an upwardly-extending angled member 136. An aperture or slot 138 is formed within the plate separating base portion 134 from angled member 136. Preferably, peripheral edges of bracket 120 are smooth and generally curved. The provision of aperture 138 and upwardly-extending member 136 renders plate 120 generally V-shaped.

Figure 12:
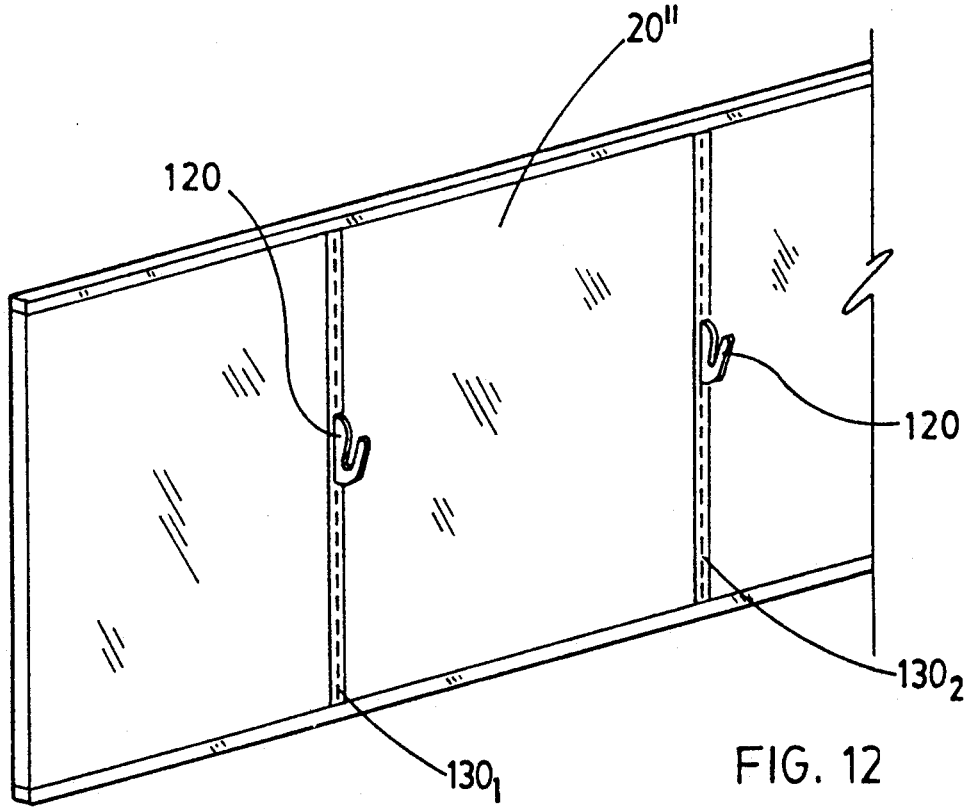
FIG. 12 provides a perspective view of a wall panel having vertical slotted standards, with a pair of the V-shaped plates of FIG. 10, mounted therein.
Figure 13:
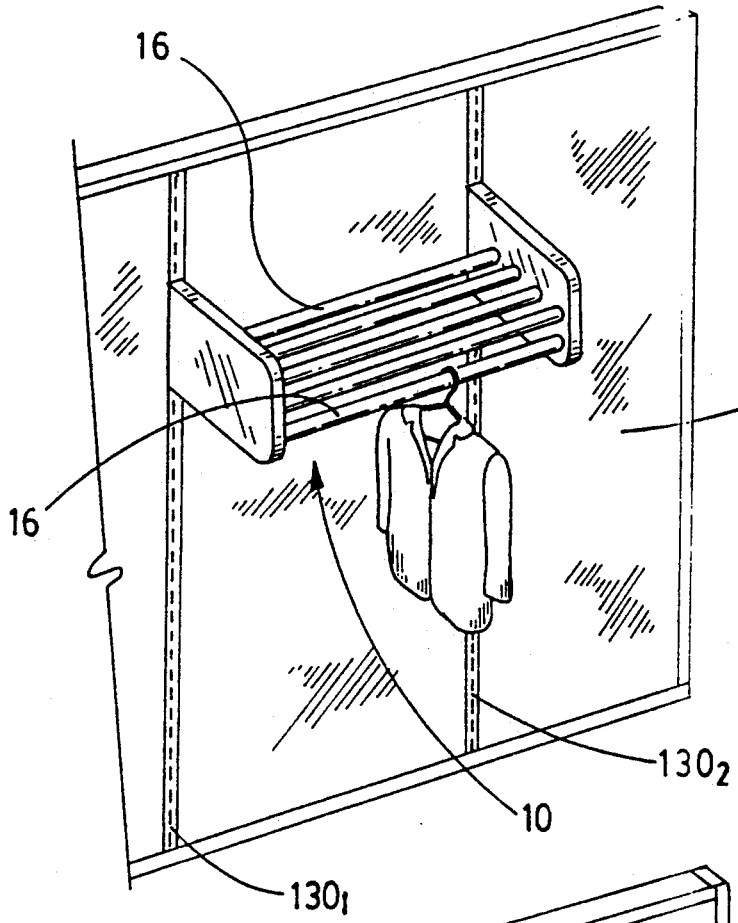
FIGS. 13 and 14 are perspective views of the complete apparatus of alternative embodiments of the invention, shown mounted to a wall panel and shown respectively holding a coat rack and a set of books on a single bookshelf.

As can be seen from FIG. 9, aperture 122 formed within wall 50 of main panel 22 has an internal periphery shaped to substantially match an external peripheral edge of plate 120. Plate 120 is closely received within aperture 122 to securely mount support panel 12 to vertical standard 130, as shown. FIG. 12 illustrates a pair of V-shaped plates 120 mounted into parallel spaced vertical standards $130_1$ and $130_2$ provided within a wall panel 20". FIG. 13 illustrates a complete mounting apparatus 10 mounted over plates 120. The length of coat rack bar 16 is selected to match the spacing between vertical standards $130_1$ and $130_2$.

Figure 14:
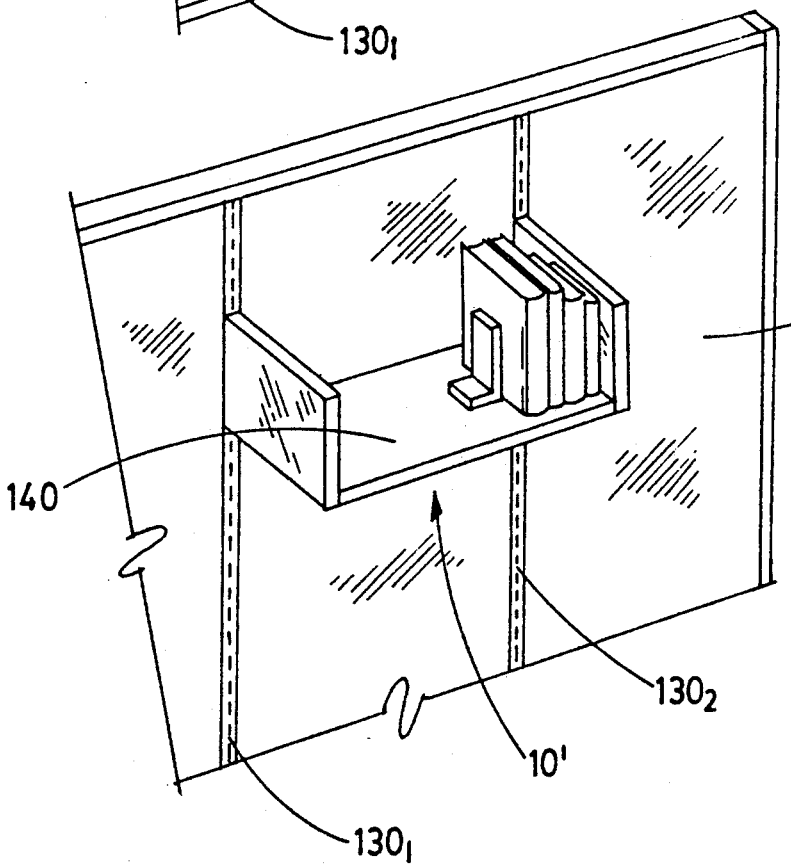

FIG. 14 provides an alternative embodiment of the mounting apparatus 10' which includes a bookshelf 140 rather than a set of coat racks 16. To accommodate bookshelf 140, side panels 12 and 14 may be provided with a single horizontal slot for receiving ends of the bookshelf rather than the set of circular cylindrical shafts described above. Alternatively, although not shown, bookshelf 140 may be provided with end portions defining male members which are mounted into the cylindrical shafts of support panels 12 and 13.

What has been described is a mounting apparatus for mounting either along a top edge of a wall panel or along a set of slotted standards on a front surface of a wall panel. The apparatus includes a pair of side supports which may support opposing ends of coat racks, bookshelves or the like. One of two specific mounting mechanisms are provided. The first, an L-shaped bracket, allows the apparatus to be mounted over the top edge of the wall panel. The second, a V-shaped hook plate, allows the apparatus to be mounted into slotted standards. A single pair of side supports accommodates either mounting arrangement. A customer may be provided with both the L-shaped mounting bracket and the V-shaped plate to allow the customer to choose the desired mounting method and location.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An apparatus for mounting an accessory to a wall panel comprising:

left and right vertical support panels wherein the vertical support panels each include a housing having a horizontal top wall and left and right vertical side walls;

wall panel mounting means, provided with each support panel, for mounting a rear edge of a respective support panel to a front surface of a vertical wall panel, the vertical support panels being mounted in spaced relation from each other wherein the wall panel mounting means for securing the support panel to the wall panel comprises:

a mounting bracket having a base portion held along a lower inside surface of the top wall and a free end portion mountable over a top edge of the wall panel; and a means for sliding the base portion with respect to the top wall of the support panel to secure the free end of the bracket over the top of the wall panel; and accessory mounting means, provided on each support panel, for receiving and holding one end of a pair of opposing ends of the accessory.

2. The apparatus of claim 1, wherein the support panels each include a leveling means for leveling the support panel with respect to a horizontal axis aligned perpendicular to the wall panel, such that a top wall of the support panel is oriented horizontally.

3. The apparatus of claim 2, wherein the leveling means comprises:

an abutment member mounted to the support panel in the vicinity of an open rear edge thereof;

the abutment member extendable through the open rear edge to abut the wall panel and extendable by a selectable amount, such that the abutment member holds a portion of the support panel away from the wall panel by a selectable amount sufficient to orient the top wall of the support panel horizontally.

4. The apparatus of claim 3, wherein the abutment member comprises:

an eccentric circular disk having a bore formed at an intermediate position between a center of the disk and an outside periphery of the disk, the bore of the disk being fitted over a mounting peg mounted near the rear wall of the support panel, whereby a portion of the disk extends through the open rear wall and abuts the front surface of the wall panel with a distance by which the disk extends through the open rear wall being determined by an angular position of the disk about the mounting peg.

5. The apparatus of claim 1, wherein the bracket is slidably mounted in a mounting track provided along the top inner surface of the side wall panel.

6. The apparatus of claim 1 further comprising a means for statically transferring force acting on the top wall of the housing onto the side walls of the housing.

7. The apparatus of claim 6, wherein the means for statically transferring force comprises a vertical plate integrally formed with a horizontal track that supports the base portion of the mounting bracket, the vertical plate being disposed along an inner side surface of the support panel, the vertical plate being securely mounted to at least one position of the inner side surface remote from the top wall of the housing such that weight carried by the support panel is at least partially borne by the side wall of the support panel rather than by the top wall of the support panel.

8. The apparatus of claim 2, wherein the mounting means mounts the support panel to a wall panel having a curved top edge, the mounting bracket having an L-shaped rectilinear free end, the mounting means being provided with a mounting block means, the mounting block means having a lower surface curved to snugly fit over the curved top edge of the wall panel and a rectangular top surface side for being closely received with the L-shaped rectilinear free end of the mounting bracket.

9. The apparatus of claim 8, wherein the mounting block means comprises a pair of mounting blocks, with a first member of the pair being positioned over a forward top edge of the wall panel with a second member of the pair being positioned over a rear top edge of the wall panel, the pair of mounting blocks together providing a planar upper surface received within the L-shaped free end of the mounting bracket.

10. The apparatus of claim 1, wherein the mounting means comprises slot mounting means for engaging with slots of a vertical slotted standard in the wall panel.

11. The apparatus of claim 10, wherein the slot mounting means further comprises:

an integrally-formed hook plate having one or more depending tabs, each sized for insertion into a slot of the slotted standard, the hook plate forming an upwardly-pointing V-hook; and an aperture formed in a rear portion of the support panel, the aperture being sized and shaped for closely receiving the hook plate such that the support panel is mountable to the hook plate while the hook plate is mounted to the slotted standard.

12. An apparatus for mounting an accessory to a wall panel, comprising:

left and right vertical side support panels, each including a housing having a horizontal top wall and left and right vertical side walls;

accessory mounting means, provided on each support panel, for receiving and holding one end of a pair of opposing ends of the accessory;

mounting means for mounting a rear edge of a respective support panel to a front surface of a vertical wall panel; and a leveling means for leveling the support panel with respect to a horizontal axis perpendicular to the wall panel, the leveling means including an eccentric circular disk having a bore formed at an intermediate position between a center of the disk and an outside periphery of the disk, the bore of the disk being fitted over a mounting peg mounted near an open rear wall of the support panel, whereby a portion of the disk extends through the open rear wall and abuts the front surface of the wall panel with a distance by which the disk extends through the open rear wall being determined by an angular position of the disk about the mounting peg.

13. An assembly capable of mounting an accessory to different types of wall panels, comprising:

left and right vertical support panels, each vertical support panel including a housing having a horizontal top wall and left and right vertical side walls;

accessory mounting means, provided on each vertical support panel, for receiving and holding one end of a pair of opposing ends of the accessory alternative mounting means, provided in each vertical panel, for mounting a rear wall of the vertical support panel to a front surface of a first type of wall panel having a top edge and a second type of wall panel having a slotted vertical standard comprised of:

first alternative means for mounting the vertical support panels along the top edge of the first type of wall panel, with a rear wall of each vertical support panel depending downward from the top edge of the wall panel along a front surface of the wall panel, said first alternative means comprised of a mounting bracket having a base portion held along a lower inside surface of the top wall and a free end portion mountable over the top edge of the wall panel; and second alternative means for mounting the vertical support panels into the slotted vertical standards of the second type of wall panel, with a rear wall of each support panel being held against a respective vertical standard.

14. The assembly of claim 13 wherein the second alternative mounting means comprises:

a mounting bracket with a base, mounting tabs located along a rear edge of the base and sized for insertion into an interior hollow portion of the slotted vertical standards, and an upwardly-extending angle member; and an inverted upwardly extending angled aperture formed in the rear wall of each support panel which receives the upwardly-extending angled member of the mounting bracket.

* * * * *